US009988813B2

(12) United States Patent
Tallarida

(10) Patent No.: US 9,988,813 B2
(45) Date of Patent: Jun. 5, 2018

(54) FORMWORK PLATE FOR WALLS AND ARCHES

(71) Applicants: Dominique Tallarida, Sospel (FR); Denis Mary, La Thales (MC)

(72) Inventor: Dominique Tallarida, Sospel (FR)

(73) Assignee: Denis Mary, Sospel (FR)

( * ) Notice: Subject to any disclaimer, the term of this patent is extended or adjusted under 35 U.S.C. 154(b) by 0 days. days.

(21) Appl. No.: 15/301,119

(22) PCT Filed: Mar. 31, 2015

(86) PCT No.: PCT/EP2015/057129

§ 371 (c)(1),
(2) Date: Sep. 30, 2016

(87) PCT Pub. No.: WO2015/150431

PCT Pub. Date: Oct. 8, 2015

(65) Prior Publication Data

US 2017/0114538 A1 Apr. 27, 2017

(30) Foreign Application Priority Data

Apr. 3, 2014 (FR) ..... 14 00808

(51) Int. Cl.

| | |
|---|---|
| ***E04B 2/86*** | (2006.01) |
| ***E04B 1/32*** | (2006.01) |
| ***E04C 2/00*** | (2006.01) |
| ***E04B 1/16*** | (2006.01) |
| ***E04G 17/06*** | (2006.01) |
| ***E04G 11/02*** | (2006.01) |

(52) U.S. Cl.
CPC ..... *E04B 2/8623* (2013.01); *E04B 1/167* (2013.01); *E04B 1/3205* (2013.01); *E04C 2/00* (2013.01); *E04G 11/02* (2013.01); *E04G 17/06* (2013.01); *E04B 2001/3276* (2013.01); *E04C 2002/004* (2013.01)

(58) Field of Classification Search
CPC ..... E04B 2/8623; E04B 1/3205; E04B 1/167; E04B 2001/3276; E04C 2/00; E04C 2002/004; E04G 17/06; E04G 11/02; E04G 1/167
See application file for complete search history.

(56) References Cited

U.S. PATENT DOCUMENTS

| | | | | |
|---|---|---|---|---|
| 9,403,338 | B2 * | 8/2016 | Tuczek | B31D 3/005 |
| 2002/0011034 | A1 * | 1/2002 | Weir | E04H 17/168 52/70 |

(Continued)

*Primary Examiner* — Brian E Glessner
*Assistant Examiner* — Joshua K Ihezie
(74) *Attorney, Agent, or Firm* — Hauptman Ham, LLP

(57) ABSTRACT

The present invention relates to a formwork plate comprising a flat rectangular central body extended in a first direction by a first series of flat tabs and in a second opposing direction by a second series of flat tabs, the tabs extending in the plane of the body while leaving a spacing between tabs of the same series, the plate having first and second sets of angled tabs, with each angled tab extending into the spacing between two flat tabs respectively from the first or second series, the tabs being angled while extending the body each having an angled portion and a flat distal end portion extending parallel to the flat tabs. The invention also relates to a formwork made from several plates.

22 Claims, 5 Drawing Sheets

(56) References Cited

U.S. PATENT DOCUMENTS

| | | | | |
|---|---|---|---|---|
| 2007/0116977 | A1* | 5/2007 | Maus | B01J 35/04 428/593 |
| 2009/0158686 | A1* | 6/2009 | Oki | B21D 47/02 52/643 |
| 2009/0255205 | A1* | 10/2009 | Noble | B32B 3/10 52/630 |
| 2011/0030287 | A1* | 2/2011 | Moore | E04D 13/1625 52/95 |
| 2011/0189525 | A1* | 8/2011 | Palanchon | H01M 10/615 429/120 |

* cited by examiner

FORMWORK PLATE FOR WALLS AND ARCHES

TECHNICAL FIELD OF THE INVENTION

The invention relates to formwork building construction assistance elements using formwork plates. One particularly advantageous application is the field of production of any type of construction elements, for a building, such as walls, floors, arches and ceilings, wherein at least one self-standing absorptive form is used.

STATE OF THE ART

Several types of formwork plates exist for producing a formwork which will be filled with a filling material so as to be solidified and form a framing for a construction element of a variable shape.

The document FR-A-913 772 describes a formwork used both for immobilizing a fluid filling material used for building a construction element and a decorative element thereon. The formwork described in this document is made from parts each comprising a panel and a girt made integral together, with the girt extending perpendicularly to the panel.

The formwork consists of several parts, at least two of which are positioned head-to-foot while defining a parallelepiped internal space intended to receive a filling material. The limits of the internal space are obtained on each one of the opposite sides of the assembly formed by the two parts by a girt and on each one of the other sides by a panel. The panel is intended to form the visible part of a wall whereas the girt is embedded in a filling material. In the case of a succession of assemblies consisting of two parts, as mentioned above, the girts of two successive assemblies each have a hole, so that the filling material can flow from one two-part assembly to the following assembly, in order to fill all the successive internal spaces of the assemblies.

Such formwork has many drawbacks. First, it cannot be enlarged laterally, unless series of successive assemblies are positioned laterally against one another. Besides, making the formwork plates integral is not easy, since this can be provided by adding one element between the girts of two successive plates, with such element being a "C" for instance. Eventually, the integral piece always has significant dimensions because of the girt which is perpendicular to the panel.

The aim of the present invention consists, on the one hand, in designing a formwork plate having minimum dimensions while being easily adapted to other plates, so as to simply and efficiently obtain a formwork made of several plates, and, on the other hand, to ensure, in the thus formed formwork, a correct holding of the plates which it is made of, prior to the complete introduction of a filling material inside the formwork.

SUMMARY OF THE INVENTION

For this purpose, the invention relates to a formwork plate comprising a flat, preferably rectangular central body. The central body is extended on a first side by a first series of flat tabs and on a second opposite side by a second series of flat tabs, with the flat tabs extending in the plane of the body while leaving a spacing between the flat tabs of the same series, with the plate further having first and second sets of angled tabs, with at least some, and preferably each angled tab(s) of the first set extending into the spacing between two flat tabs of the first series, and at least some, and preferably each angled tab(s) of the second set extending into the spacing between two flat tabs of the second series, with the tabs of the first and second sets being angled while extending away from the flat central body each having an angled portion and a flat distal end portion extending parallel to the flat tabs.

Thanks to its flat rectangular body, such a substantially flat formwork plate has reduced overall dimensions. This enables an easier stacking of the formwork plates, specifically on a pallet, prior to the use thereof, with the angled tabs being oriented upwards.

Besides, the fixing of a plate with another plate in the extension thereof already exists in the plate as flat tabs and the spacing between these, which simplifies the fixing of such plates.

This is made possible by a different distribution of the series of flat tabs on two sides of the plates, with such series being complementary, with the tabs of a first series of tabs on one side of a first plate which can be inserted between the tabs of a second series of tabs of a second plate positioned as an extension of the first plate.

The distal end portion of each angled tab, which is flat, is intended to rest on the opposite plate body, and at least partly contributes to the provisional stability of the plates relative to each other, with the plates thus forming a formwork.

Eventually, the angled tabs will make it possible to define a volume between two plates opposite the angled tabs of the opposed plates, a volume which forms the volume of the formwork and is at least partially intended to contain some material, called the filling material. The at least partial introduction of some material into at least a part of the volume will make it possible to stiffen the assembly by fixing the angled tabs in the material and by preventing any undesirable motion of such angled tabs, which results in a self-stabilized formwork.

According to another object of the invention, a formwork is provided which comprises at least four of such formwork plates, characterized in that it comprises:

- at least two first formwork plates so joined that the bodies thereof are positioned in the same first plane,
- at least two second formwork plates so joined that the bodies thereof are positioned in the same second plane, which is different from the first plane and parallel to the first plane,
- with said at least two first and second plates being positioned at a distance from each other and back to back, i.e. with their angled tabs facing one another so as to at least partially define a volume inserted between the first and second plates;
- the angled tabs of said at least two first and second plates being so configured as to cooperate to form, in said volume, at least three zones, the periphery of which is at least partially defined by the angled tabs.

In addition to the above mentioned advantages as regards the formwork plate and which are also valid for the formwork, the formwork according to the invention provides for a division of the internal volume of the formwork into several zones.

This makes it possible, for four plates grouped two by two, to fill only one first zone with a material, so as to obtain an at least preliminary holding of the thus mounted formwork, but which advantageously remains final, with such first zone being defined by the cooperation of sets of angled tabs of the first and second plates facing each other.

The quantity of material to be poured into the first zone for first and second plates, i.e. at least four plates with at least two plates made integral together and opposite two other plates, also made integral together is thus reduced relative to what should be poured into the whole volume between the first and second plates. The association of angled tabs as provided for in the present invention makes it possible to obtain at least a substantially closed first zone in a direction perpendicular to the first and second plates for the filling with the material, which thus entails insignificant loss of material in the remaining part of the volume.

According to another object of the invention, a construction assembly is provided for, of the type comprising at least either a wall, or a floor, or an arch, or a ceiling, or at least two of these elements, characterized in that it comprises at least one such formwork, with a first one of said at least three zones being filled with a hardenable material, of the concrete, cement, clay, or binder types.

The first filled zone is advantageously a reduced zone, which corresponds, for instance, to a zone defined by the angled tabs of the first, second, third and fourth formwork plates. Such filling gives the formwork stability during mounting and operation. The material is hardenable or in a closed bag and advantageously quick setting, so that it can solidify the formwork as quickly as possible. Then the other zones of the formwork can also be filled with a material which may be similar to or different from the material of the first zone.

Within the scope of the invention, a method is provided for manufacturing such a construction assembly, characterized by the following steps:

connection of at least two plates positioned in the extension of each other by inserting flat tabs of one into the spacing between the flat tabs of the other one so as to obtain at least two first plates, connection of two plates positioned in the extension of each other by inserting flat tabs of one into the spacing between the flat tabs of the other one so as to obtain at least two second plates, positioning said at least two first and two second plates with the angled tabs thereof facing one another, inserting angled tabs of said at least two first plates between the angled tabs of said at least two second plates, until the flat distal end portions of the angled tabs of said at least two first plates are supported by said at least two second plates and vice versa, the angled tabs of said at least two first and second plates at least partially defining at least three zones in the volume between said at least two first and said at least two second plates, with, for defining one side of a first zone, the angled tabs of one of said at least two first plates being inserted between the angled tabs of one of said at least two second plates and for defining the opposite side of the first zone, with the angled tabs of the other one of said at least two first plates being inserted between the angled tabs of the other one of said at least two second plates, positioning and holding side plates on at least one side having no tab of said at least two first and second plates, if need be, repeating the preceding steps for positioning additional plates in the extension of said at least two first and second plates while forming said at least three zones, among which the first zone and/or, for positioning additional side plates in addition to said at least two first and second plates, when a construction of said at least one formwork is complete for manufacturing a construction assembly, introducing a material of the concrete, cement, clay or binder or sand bag type into the/each first zone, if need be, introducing a material into the remaining zones among said at least three zones.

BRIEF DESCRIPTION OF THE FIGURES

The aims, objects, characteristics and advantages of the invention will be better understood upon reading the detailed description of one embodiment thereof which is illustrated in the appended drawings, wherein.

Figure 1:
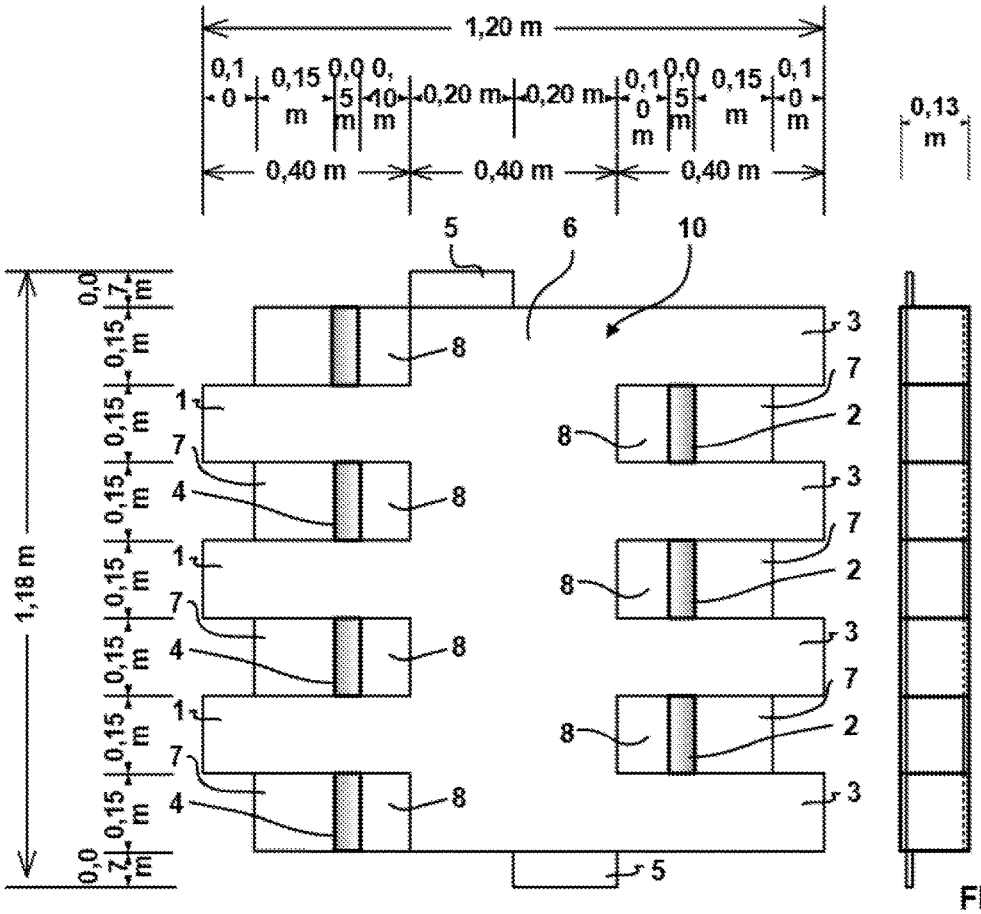
FIG. 1 is a schematic top view of one embodiment of a formwork plate according to the present invention, mentioning the dimensions of such formwork plate for this embodiment.

The drawings are given for example only and are not restrictive as regards the invention. They are principle schematic views intended to facilitate the understanding of the invention and are not necessarily to scale of the practical applications. More particularly, the dimensions of the various parts are not representative of reality.

DETAILED DESCRIPTION OF THE INVENTION

Prior to making a detailed review of the various embodiments of the invention, optional characteristics will be mentioned hereunder, which may be used either in association or alternately:

- each angled portion of the angled tabs forms an angle with the flat tab portion connected with the central body, as well as with the flat distal end portion, with the angle ranging from 100° to 120° and preferably from 110° to 115°.
- said angle is equal to 112°.
- the angled portion of each angled tab is connected to the flat central body by a flat connecting portion.
- the sides of the central body carrying no tab each carry a pin. This is advantageous for connecting a plate on a side carrying no tab.
- the first series of flat tabs on the first side is shifted relative to the second series of flat tabs on the second side, with each flat tab of the first series being aligned with a spacing between two flat tabs of the second series and vice versa, with one of the two series of flat tabs comprising one tab more than the other series and the set of angled tabs, associated with said series of flat tabs comprising one tab more, comprises one angled tab less. As a matter of fact, as will be explained hereunder, the aim of the flat tabs is to provide an extension to a formwork plate with another formwork plate. Such an asymmetry of the series of fat tabs makes it possible for a first side of a first plate carrying the first series of flat tabs to be attached to a second side carrying the second series of flat tabs of another plate. Except for the end plates of a formwork optionally, all the formwork plates are the same as regards the asymmetrical series of tabs, which makes it possible to use only one type of plates to produce the formwork.
- the number of flat tabs of the first and second series is three and four respectively, whereas the number of angled tabs of the first and second sets is four and three respectively.
- the width of the flat tabs of the same series among the first and second series is constant for all the tabs of the series and the width of the spacing between the flat tabs of one series among the first and second series is equal to the width of the flat tabs of the other series.
- the plate is made of wood or based on aggregate particles.
- the plate is molded.
- as regards the formwork, the flat distal end portions of the angled tabs of said at least two first plates are supported by at least two second plates and vice versa. Such flat distal end portions enable a better contact between the angled tables and the opposed formwork plate.
- the formwork comprises formwork plates positioned side by side with said at least two first and second plates, while being adjacent to said at least two first and second plates on one side having no tabs, with each formwork plate having a side pin on each side having no tabs, with the side pin of each plate cooperating with the body of a plate positioned laterally and vice versa for holding the two plates together. This is a simple and efficient means to connect two laterally positioned plates while still using only one type of plates.
- the flat tabs of one of said two first plates are inserted into the spacing between the flat tabs of the other one of said two first plates and the flat tabs of one of said two second plates are inserted into the spacing between the flat tabs of the other one of said two second plates. So there is no clearance between the tabs in a direction perpendicular to that of the extension of the flat tabs.
- a first zone of said at least three zones is defined, on one side, by the angled tabs of one of said at least two first plates being inserted between the angled tabs of one of said at least two second plates and, on the other side, by the angled tabs of the other one of said at least two first plates being inserted between the angled tabs of the other one of said at least two second plates, with said first zone being at the junction, in the extension of each other, of said at least two first and second plates respectively. As will be explained in greater details hereunder, creating a first zone with a reduced volume is very advantageous to stiffen the formwork, even in the course of mounting with a not completed construction assembly.
- the associated angled tabs of the two first and second plates are in an X shape, by closing each side of the first zone respectively. The X shape is advantageous for delimiting the sides of the first zone, transversally to the first and second plates by contributing to the confinement of the first zone.
- in a construction assembly, at least a first one of said at least three zones is filled with a hardenable material.
- the formwork is gone through by attachment means like screws, with such attachment means being fixed in the selective material after filling at least a first one of said at least three zones. Such attachment means form points for anchoring the formwork in the then hardened material and reinforces the holding of the various elements of the formwork together, which results in a self-stabilized formwork.

When referring to all the figures and more particularly to FIGS. 1, 3 to 5 and 11 to 14, in a first aspect of the invention, the latter refers to a formwork plate 10 intended to be one element of a formwork bearing reference 11, specifically in FIGS. 2, 6 to 11.

The formwork plate 10 comprises a rectangular flat central body 6, two opposite sides of which each carry two types of tabs, i.e. flat tabs 1, 3 and angled tabs 4, 7.

The central body 6 is extended, on a first side, by a first series of flat tabs 1 and, on a second opposite side, by a second series of flat tabs 3. The flat tabs 1, 3 extend in the plane of the body 6 while leaving some spacing between the flat tabs 1, 3 in the same series. The flat tabs 1, 3 advantageously have a rectangular shape, with a length perpendicular to the opposite sides which carry these, respectively.

The formwork plate 10 further has a first and a second sets of angled tabs 4, 7; 2, 7. Each angled tab 4, 7 of the first set extends into the spacing between two flat tabs 1 of the first series, each angled tab 2, 7 of the second set extends into the spacing between two flat tabs 3 of the second series. The angled tabs 4, 7; 2, 7 of the first and second sets are angled away from the flat central body 6 and comprise each an angled portion 2, 4, and a flat distal end portion 7 which extends parallel to the flat tabs 1, 3.

Advantageously, prior to the angled portion 2, 4 of each angled tab 4, 7; 2, 7, each angled tab 4, 7; 2, 7 can be connected to the body 6 through a connecting portion 8 clearly seen in FIGS. 1, 1*a*, 4, 13 and 14. Such connecting portion 8 is advantageously flat and extends parallel to the flat tabs 1, 3.

Figure 1A:
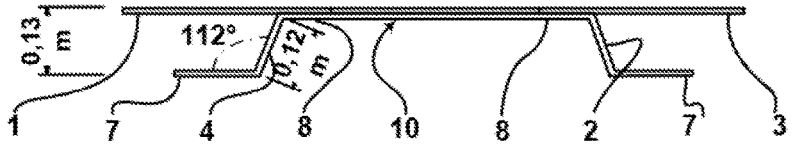
FIG. 1*a* is a schematic cross-sectional view of the formwork plate of FIG. 1.
Figure 4:
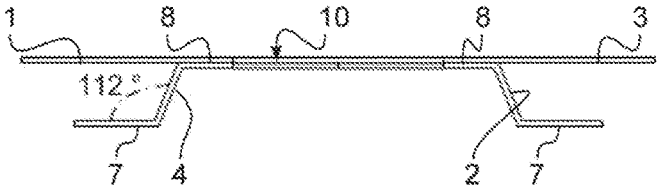
FIG. 4 is a schematic cross-sectional view of the formwork plate of FIG. 3.

As more particularly shown in FIGS. 1*a* and 4, each angled portion 2, 4 of the angled tabs 4, 7; 2, 7 forms an angle with the flat distal end portion 7, with such angle ranging from 100 to 120° and preferably from 110° to 115°.

As the distal end portion 7 is parallel to the flat tabs 1, 3, the result is that the same angle exists between each angled portion 2, 4 of the angled tabs 4, 7; 2, 7 and the portion of the flat tabs 1, 3 attached to the central body 6. Such angle is advantageously equal to 112°.

In a preferred embodiment of the invention, the sides of the central body 6 which carry no tab 1, 4, 7; 3, 2, 7 each carry a pin 5. As will be explained in greater details hereunder, such pin 5 is used for holding the formwork plate 10 relative to a plate positioned laterally relative to the plate 10. Side plate means any plate adjacent to another plate, on one side thereof which comprises no flat tab 1, 3.

In a construction assembly, a side plate may be above the plate adjacent thereto, in the same vertical plane as the adjacent plane, such as is the case, for instance, for a wall, or in a slightly angled plane relative to vertical, as is the case, for instance, for an arch, or in the same horizontal plane as the adjacent plane, as is the case, for instance, for a plane ceiling or a floor. This can be seen in FIG. 9 which will be thoroughly explained hereunder.

In one preferred embodiment of the present invention, the first series of flat tabs 1 on the first side is shifted relative to the second series of flat tabs 3 on the second side, so that each flat tab 1 of the first series is aligned with a spacing between two flat tabs 3 of the second series, and vice versa.

The result is that a series of two series of flat tabs 1, 3, in FIGS. 1, 3 to 5 and 11 to 14, the series carrying the flat tabs 3, comprises one tab more than the other series. As the set of angled tabs 2, 7, associated with said series of flat tab 1 comprises one tab more, then comprises an angled tab 2, 7 less.

Figure 10:
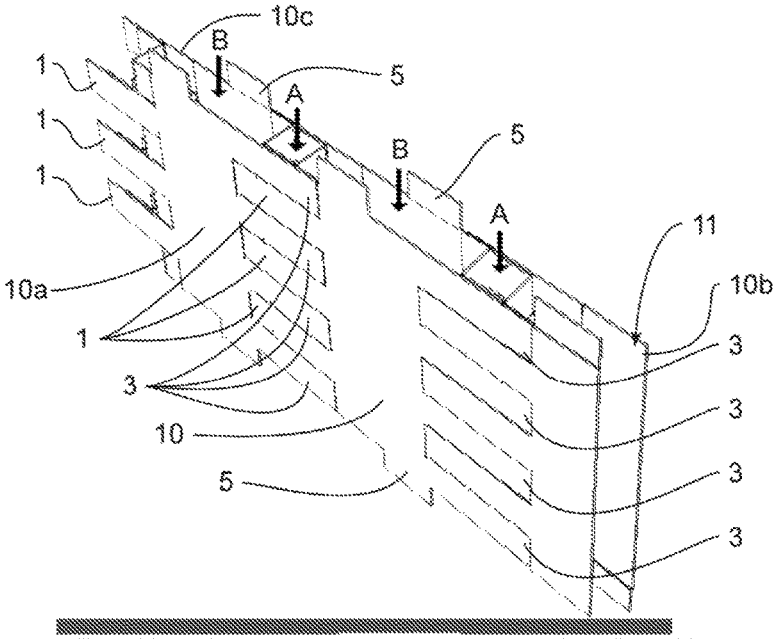
FIG. 10 is a schematic perspective view of a formwork according to one embodiment of the invention comprising two first formwork plates opposite two second formwork plates, with zones defined by the angled tabs of the formwork plates being shown in this figure.

As more specifically shown in FIG. 10, this is necessary because the tabs 3 on one side of the formwork plate 10*a* extending another formwork plate 10 and the flat tabs 1 thereof are inserted between the tabs 1 of the other formwork plate 10. Extension means here parallel to the direction of extension of the flat tabs 1, 3 away from the plate 10 which carries these.

The number of flat tabs 1, 3 of the first and second series of flat tabs can thus be three and four respectively, whereas the number of angled tabs 4, 7; 2, 7 of the first and second sets of angled tabs may be four and three respectively. This is not restrictive and the number of flat or angled tabs may be any other number, but the arrangement thereof, with some spacing between the flat tabs 1, 3 enabling the insertion of one angled tab 4, 7; 2, 7 into such spacing is still valid, as well as the shift between the two series of flat tabs 1, 3.

Similarly, the width of the flat tabs 1, 3 in the same series among the first and second series is constant for all the tabs in the series and the width of the spacing between the flat tabs 1, 3 in one series among the first and second series is equivalent to the width of the flat tabs 1, 3 of the other series.

Advantageously, the formwork plate 10 may be made of wood or based on aggregate particles. Such plate 10 may advantageously be molded in any moldable material. The formwork plate 10 can thus be reproduced in large series using a molding process.

As shown in FIG. 1, the formwork plate 10 has a rectangular-shaped body 6 and may have, not restrictively, a width of 1.18 m, including the pins 5, and a length of 1.2 m, including the flat tabs 1, 3. The thickness of such a formwork plate 10 may range from 1 to 2 cm. The body of the plate 10 may be 1.04 m×0.40 m. The flat tabs 1, 3 may be 0.40 m long and 0.15 m wide, with the spacing between two flat tabs 1, 3 being 0.15 m too.

The pins 5 may laterally protrude from the formwork plate 10 by 0.07 m, while having a width of 0.20, i.e. half the width of the body 6 of the plate 10.

The distal end portion 7 of the angled tabs 4, 7; 2, 7 may be square-shaped with 0.15 m sides. The connecting portion 8 may extend 0.10 m away from the body 6 and parallel to the length of the flat tabs 1, 3, while being 0.15 m wide. As specifically shown in FIG. 1*a*, the angled portions 2, 4 of the angled tabs 2, 7; 4, 7 may be 0.13 m high and may form, as mentioned above, a preferred angle of 112° with the distal end portion 7.

Figure 14:
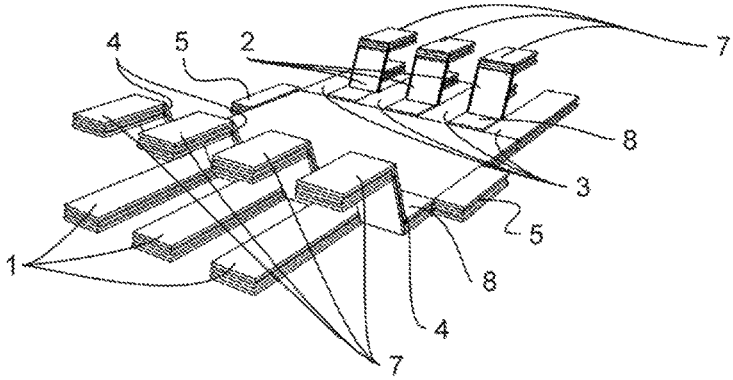
FIG. 14 is a schematic perspective top view of a stacking, for transportation purposes, of formwork plates, with each formwork plate being similar to the one shown in FIGS. 12 and 13.

The thickness between one and two centimeter(s) and the light weight of the formwork plate 10 make it possible to stack a large number of these on a pallet, as shown in FIG. 14. This facilitates transportation, gives smaller oversize dimensions, and optionally makes it possible to save fuel for transportation.

According to a second aspect of the present invention, the latter relates to a formwork, specifically illustrated in FIGS. 2, 5 to 9, 10, 11, while referring to the other figures for the references which are not mentioned in these figures. Such formwork can be easily mounted, and may be implemented by any body.

Such formwork 11 comprises at least four formwork plates 10, 10*a*, 10*b*, 10*c* similar to the formwork plate disclosed above. Said at least four formwork plates 10, 10*a*, 10*b*, 10*c* are preferably identical when these are not formwork end plates 11.

Such formwork 11 comprises at least two first formwork plates 10, 10*a*, which are so joined that their bodies 6 are positioned in the same first plane and at least two second formwork plates 10*b*, 10*c* which are so joined that their bodies 6 are positioned in the same second plane while being parallel to the first plane.

Said at least two first 10, 10*a*, and second 10*b*, 10*c* formwork plates are positioned at a distance from each other and back to back, i.e. with their angled tabs 4, 7; 2, 7 facing one another so as to at least partially define a volume 9 inserted between the first 10, 10*a* and second 10*b*, 10*c* plates.

Such volume 9 is defined by the height of the angled tabs 4, 7; 2, 7 of the plates 10, 10*a*, 10*b*, 10*c* and thus extends between the first 10, 10*a*, and second 10*b*, 10*c* formwork plates. The spacing thereof between the first 10, 10*a*, and second 10*b*, 10*c* formwork plates may be 0.13 m, which corresponds to that of the angled tabs 4, 7; 2, 7 protruding from a formwork plate 10, 10*a*, 10*b*, 10*c*.

The angled tabs 4, 7; 2, 7 of said at least two first 10, 10*a*, and second 10*b*, 10*c* formwork plates are so designed as to cooperate in order to form, in said volume 9, at least three zones A, B the periphery of which is at least partially defined by the angled tabs 4, 7.

The flat distal end portions 7 of the angled tabs 4, 7; 2, 7 of said at least two first formwork plates 10, 10*a* may be supported by said at least two second 10*b*, 10*c* plates, and vice versa.

Said at least three zones may comprise a so-called first zone A which is totally defined by the angled tabs 4, 7; 2, 7 along the dimension of the formwork 11 which is perpendicular to the length of the angled tabs 1, 3. Such first zone A will be described in greater details hereunder since it plays an important part in the stability during the production of the formwork 11.

Figure 9:
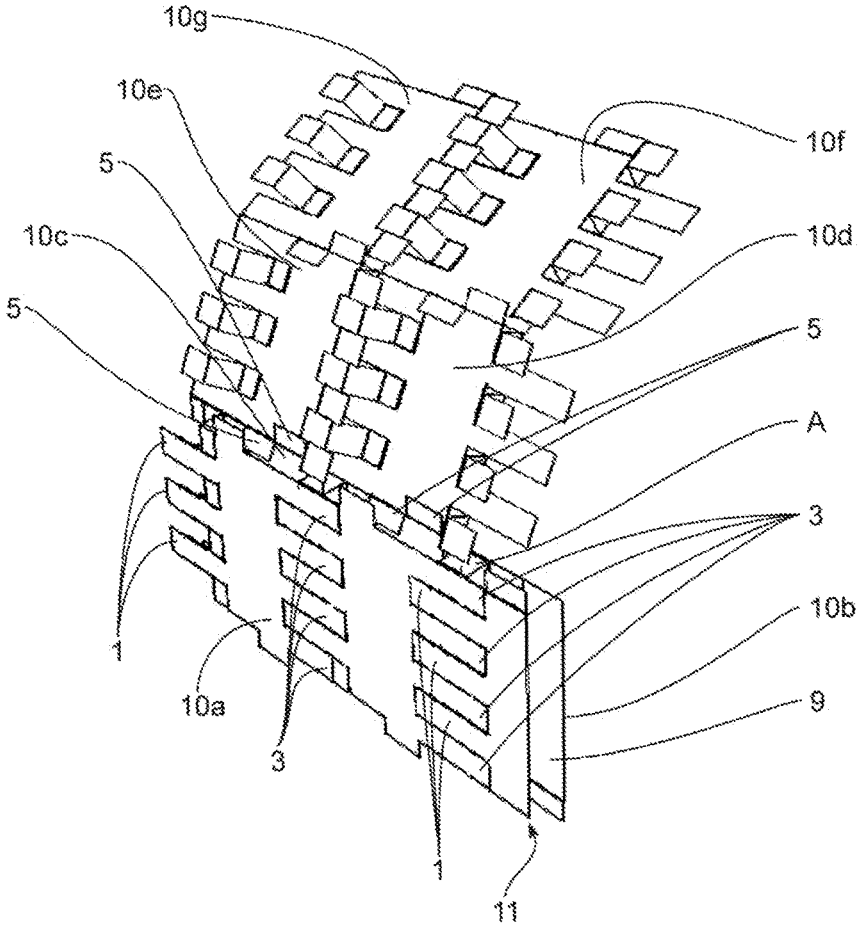
FIG. 9 is a schematic perspective view of one detail of the junction of one arch and one wall within a construction assembly produced from at least one formwork according to the present invention.

As shown in FIG. 9, in order to widen the formwork 11, more specifically sidewise, i.e. perpendicularly to the length of the flat tabs 1, 3 and thus to the succession, in the extension of said at least two first 10, 10*a*, and second 10*b*,

10*c* plates, the formwork 11 comprises side formwork plates 10*d* to 10*g*, with such plates 10*d* to 10*g* being positioned laterally to said at least two first 10, 10*a*, and second 10*b*, 10*c* plates.

For this purpose, and as mentioned above, each formwork plate 10, 10*a* to 10*g* in this FIG. 9, has a side pin 5 on each side carrying no tab 1, 4, 7; 3, 2, 7. The side pin 5 of each plate 10*b*, 10*c* cooperates with the body 6 of a side plate 10*d*, 10*e* for holding the two plates together. During the production of a construction assembly, as shown in FIG. 10, the pins 5 may contribute to the vertical assembly of the formwork 11.

In FIG. 9, only the plates 10*b* and 10*c* of said at least two second plates have side plates 10*d* and 10*e* since the side plates associated to said at least two first plates 10, 10*a* have been omitted. When positioning a side plate 10*d* or 10*e* relative to a plate 10*b* or 10*c*, the pin 5 of a plate 10*b* or 10*c* is positioned above the body of the side plate 10*d* or 10*e* and vice versa.

This remains applicable for side plates 10*f* or 10*g* positioned laterally relative to the side plates 10*d* or 10*e*, which are positioned laterally relative to two second plates 10*b*, 10*c*, and so on. This is of course true for said at least two first plates 10, 10*a* although not shown in FIG. 9.

In FIG. 9, only the plates 10*d* to 10*g* are positioned above the plates adjacent thereto and form a substantially vertical assembly. In this case, the first zone(s) A of said at least three zones extend substantially vertically, transversely to the series of superimposed adjacent plates 10*c*, 10*e*, 10*g*; 10*b*, 10*d*, 10*f*. This is advantageous for filling the first zone A which is facilitated by gravitation, with the material penetrating, advantageously flowing into, the whole of the first zone(s) A, when the filling inlet of the first zone(s) A is provided through the last, i.e. the highest, side plates 10*f*, 10*g*.

Referring to all the figures, in a preferred embodiment of the invention, the flat tabs 1, 3 of one 10 of said two first plates 10, 10*a*, are inserted into the spacing between the flat tabs 1, 3 of the other one 10*a* of said two first plates 10, 10*a*, and vice versa. Similarly, the flat tabs 1, 3 of one 10*b* of said two second plates 10*b*, 10*c* are inserted into the spacing between the flat tabs 1, 3 of the other one 10*c* of said two second plates 10*b*, 10*c*, and vice versa.

This is made possible because such flat tabs 1, 3 are shifted on each one of the two sides of a formwork plate 10 and because of the same width of the flat tabs 1, 3 and of the spacing thereof between each one of the flat tabs 1, 3 in the same series.

Referring to all the figures and specifically to FIGS. 1*a*, 2, 6, 7, 10 and 11 in a preferred embodiment of the invention, a first zone A of said three zones A, B is defined, on one side, by the angled tabs 4, 7; 2, 7 of one 10 of said at least two first plates 10, 10*a* which are inserted between the angled tabs 4, 7; 2, 7 of another one 10*b* of said at least two second plates 10*b*, 10*c*.

On the other side, the first zone A is defined by the angled tabs 4, 7; 2, 7 of the other one 10*a* of said at least two first plates 10, 10*a* which are inserted between the angled tabs 4, 7; 2, 7 of the other one 10*c* of said at least two second plates 10*b*, 10*c*. The first zone A is positioned at the junction, in the extension of said at least two first plates 10, 10*a* and second plates 10*b*, 10*c* respectively.

In this embodiment, the associated angled tabs 4, 7; 2, 7 of the two first and second plates 10, 10*b*; 10*a*, 10*c* are in an X shape, by closing each side of the first zone A. The first zone A is thus partitioned in a direction transversal to the plates 10, 10*a*, 10*b*, 10*c* perpendicular to the respective extensions of the first 10, 10*a*, and second 10*b*, 10*c* plates.

Figure 11:
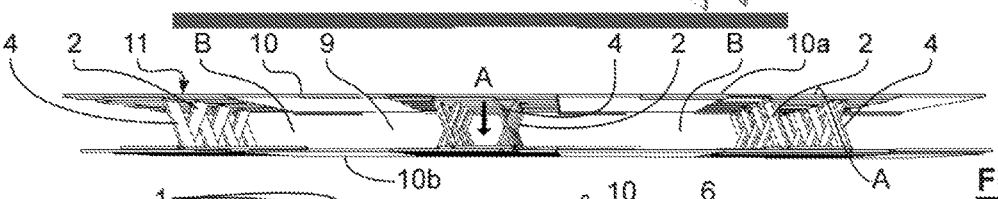
FIG. 11 is a schematic perspective side view of the embodiment of a formwork according to FIG. 10, with the volume between the first and second formwork plates being clearly visible in this figure and at least three zones defined by the angled tabs being identified.

As can be seen specifically in FIG. 11, the first zone A has a smaller section than that of the zones B and is better partitioned than the zones B, which are partitioned on only two opposite sides when additional first and second plates are added to said at least two first and second plates 10, 10*a*, 10*b*, 10*c*. The zone A is surrounded by a zone B, on each side thereof.

Assembling several plates 10, 10*a* 10*b*, 10*c* thus makes it possible to obtain a self-stabilized absorptive formwork 11 which can be used for building walls, arches or other construction assemblies.

Figure 8:
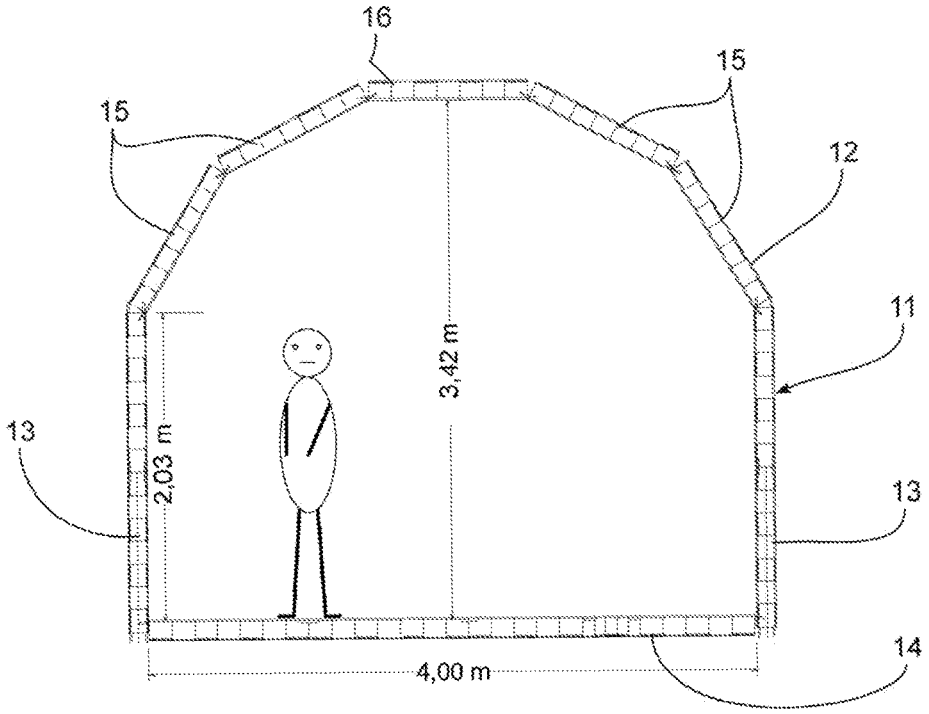
FIG. 8 is a schematic sectional view of one construction assembly comprising two walls, one floor and one arch, with such assembly being produced from at least one formwork according to the present invention.

Referring to all figures and specifically to FIG. 8, according to another aspect of the present invention, the latter relates to a construction assembly 12 to 15 of the type comprising at least one wall 13 or one floor 14, or one arch 15 or one ceiling 16, with such assembly comprising at least one formwork 11, with said at least three zones A, B being filled with a selective material, of the concrete, cement, clay, straw, soil, or binder types. Such an assembly may also contain two or more of such elements 12 to 15 or all such elements 12 to 15 and form a complete construction assembly.

In the same line, and without any restriction, the floor may be 4 m long, the walls 13 may be 2.03 m high and the ceiling may be 3.42 m high and be raised relative to the walls 13 by the arch elements 15.

Referring to all figures, a first zone A may be provided for each formwork 11 comprising two first 10, 10*a*, and two second 10*b*, 10*c* formwork plates. Since a formwork 11 may comprise more than two first and second plates 10, 10*a*, 10*b*, 10*c*, as many first zones A as there are groups of two first and two second plates 10, 10*a*, 10*b*, 10*c* may advantageously be provided.

The first zone(s) A and the other zones B of a formwork 11 may be sequentially filled, with the first zone A first, so as to stiffen the formwork, and then, if required, the remaining other zones B. The material of the first zone(s) A may be hardenable, advantageously quick-setting, so that the formwork 11 can solidify as quickly as possible.

Filling one or first zones A with, for instance, concrete, cement, compressed clay soil or any other advantageously hardenable material prevents the formwork plates 10, 10*a* to 10*d* from moving away from one another.

In a preferred embodiment of the invention, the formwork 11 may be gone through by attachment means like screws, with such attachment means, not shown in the figures, being fixed in the selective material after filling said at least three zones A, B. All attachments use screws and are oriented inwards relative to the formwork 11, and the screws are over five centimeters long. This is specifically but not only true for the first zone(s) A.

When the first zone(s) A are hard, the zones B may be filled using all kinds of materials like concrete, soil or straw. They also may not be filled when the construction element concerned needs no reinforced stability.

As shown in FIG. 8, according to the invention, construction assemblies containing straight and arched elements may be built. Such construction assemblies may, for instance, form a house. A formwork plate cut into two parts heightwise may give two formwork 11 edge plates.

Referring to all figures, according to a last aspect of the present invention, the latter relates to a method for manufacturing a construction assembly 12 to 15 with a step of connecting at least two 10, 10*a* plates positioned in the extension of each other by inserting flat tabs 1, 3 of one into the spacing between the flat tabs 3, 1 of the other one so as to obtain at least two first 10, 10*a* plates.

Simultaneously, a step of connecting two plates positioned in the extension of each other by inserting flat tabs 1, 3 of one into the spacing between the flat tabs 3, 1 of the other one is also executed, so as to obtain at least two second plates 10*b*, 10*c*.

The following steps of the method relate to the positioning of said at least two first 10, 10*a* and two second 10*b*, 10*c* plates with the angled tabs 4, 7; 2, 7 thereof facing one another, then the inserting of angled tabs 4, 7; 2, 7 of said at least two first 10, 10*a* plates between the angled tabs 4, 7; 2, 7 of said at least two second 10*b*, 10*c* plates, until the flat distal end portions 7 of the angled tabs 4, 7; 2, 7 of said at least two first 10, 10*a* plates are supported by said at least two second 10*b*, 10*c* plates and vice versa. Advantageously flat distal ends 7 of the angled tabs 4, 7; 2, 7 are supported by the opposite plates 10, 10*a*, 10*b*, 10*c*.

The angled tabs 4, 7; 2, 7 of said at least two first 10, 10*a* and second 10*b*, 10*c* plates then at least partially define at least three zones A, B in the volume 9 between said at least two first 10, 10*a* and said at least two second 10*b*, 10*c* plates.

One side of a first zone A is defined by the angled tabs 4, 7; 2, 7 of one 10 of said at least two first 10, 10*a* plates being inserted between the angled tabs 4, 7; 2, 7 of one 10*b* of said at least two second 10*b*, 10*c*. The opposite side of the first zone A is defined by the angled tabs 4, 7; 2, 7 of the other one 10*a* of said at least two first 10, 10*a* plates being inserted between the angled tabs 4, 7; 2, 7 of the other one 10*c* of said at least two second 10*b*, 10*c* plates. The first zone A is thus defined transversally to the plates 10, 10*a*, 10*b*, 10*c* in the volume 9, i.e. perpendicularly to the flat tabs 1, 3 of the formwork plates 10, 10*a*, 10*b*, 10*c*.

The next step consists in positioning and holding side plates 10*e* to 10*g* on at least one side having no tab of said at least two first 10, 10*a* and second 10*b*, 10*c* plates. This may be provided by a pin 5 holding each one of said side plates 10*e* to 10*g* relative to its plate among said at least two first 10, 10*a*, and second 10*b*, 10*c* plates, and vice versa.

If need be, for a formwork 11 comprising more than two first and second plates 10, 10*a*, 10*b*, 10*c*, and possibly several side plates 10*e* to 10*g*, the preceding steps of positioning additional plates in the extension of said at least two first 10, 10*a* and second 10*b*, 10*c* plates while forming said at least three zones A, B, among which the first zone A are repeated.

This may also be executed in addition to, or instead of positioning additional side plates 10*f* to 10*g* in addition to said at least two first 10, 10*a* and second 10*b*, 10*c* plates. Such additional side plates 10*f*, 10*g* may, for instance, be positioned relative to already positioned side plates 10*e*, 10*f*, or on the other opposite side having no flat tab 1, 3 of the first 10, 10*a*, and second 10*b*, 10*c* plates.

In the last two steps of the method according to the present invention, when a construction of said at least one formwork 11 is complete for manufacturing a construction assembly 12 to 15, a material of the concrete, cement, clay or binder type is introduced into the/each first zone A, advantageously cast therein, and if need be, material is introduced into the remaining zones B of said at least three zones A, B.

According to another embodiment which may be combined with all the characteristics mentioned above, the present invention relates to a molded formwork plate, made of molded wood based on aggregate particles, or any moldable material.

The thickness ranges from 1 cm to 2 cm and the light weight of the plate, as shown in FIG. 14, makes it possible to store these by stacking a large number of plates on a pallet, which ensures an easy transportation, fuel saving and small dimensions. The easy assembling thereof enables implementation by anybody.

Figure 2:
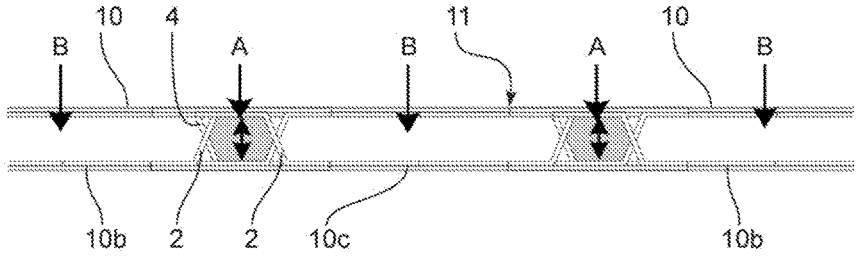
FIG. 2 is a schematic side view of one embodiment of a formwork according to the present invention, with such formwork comprising at least eight formwork plates.

The plate is obtained by molding wood or any other moldable product, with the detailed dimensions in FIG. 1. Assembling several of these plates makes it possible to obtain a self-stabilized absorptive formwork to build walls, arches, or anything else. As shown in FIGS. 2, 10 and 11, such formwork is characterized in that it comprises, by associating four identical plates, a zone A which will prevent plates from moving away from each other after filling with concrete or compressed clay soil. When zones A are hard, the zones B may be filled with any kind of materials, such as concrete, soil or straw.

The plate consists of seven 15 cm horizontal parts, 3 on one side, and 7 on the other side, which enables horizontal assembling, and of two 7 cm pins, one at the top and one at the bottom of the plate which enables vertical assembling. To obtain the 13 cm depth of the formwork, the plates are attached together back to back using seven tabs having an angle of 112°, and ending in a flat surface shown in FIGS. 3, 4, 5, 6 and 7. Both pins will be positioned at the back of the higher and lower zones. Assembling, depthwise, is obtained by fixing the tabs on the plates positioned back to back. All the attachments are provided by screws and are oriented inwards relative to the formwork, and the screws are over five centimeters long, and will be buried in the filling product 30 of the formwork.

Figure 12:
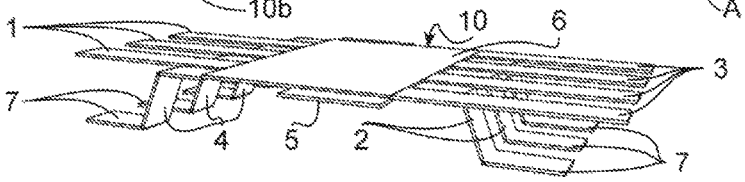
FIG. 12 is a schematic perspective side view of one embodiment of a formwork plate according to the present invention.
Figure 13:
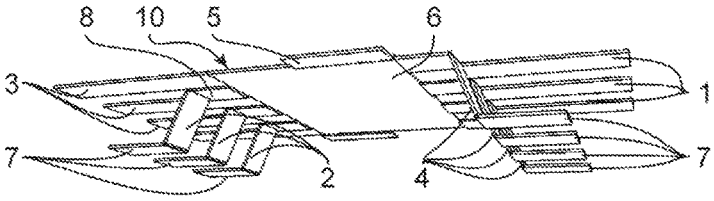
FIG. 13 is a schematic perspective bottom view of the formwork plate of FIG. 12.

As shown in FIG. 8, the method makes it possible to build straight and arched houses. A formwork plate cut into two parts heightwise gives two formwork 11 edge plates. FIGS. 12 and 13 show the plate, in 3 dimensions. The present plate can be reproduced infinitely, using a molding process.

The plate according to the invention may have the following characteristics:

The plate is a molded formwork plate, made of molded wood composed of aggregate particles or any other moldable product, characterized in that it comprises, by associating four identical plates, a zone A which will prevent plates from moving away from each other after filling with concrete or compressed clay soil.

The plates are provided with seven tabs having an angle of 112°, and ending in a flat surface shown in FIGS. 3, 4, 5, 6 and 7, which makes it possible to attach same together, back to back.

Figure 3:
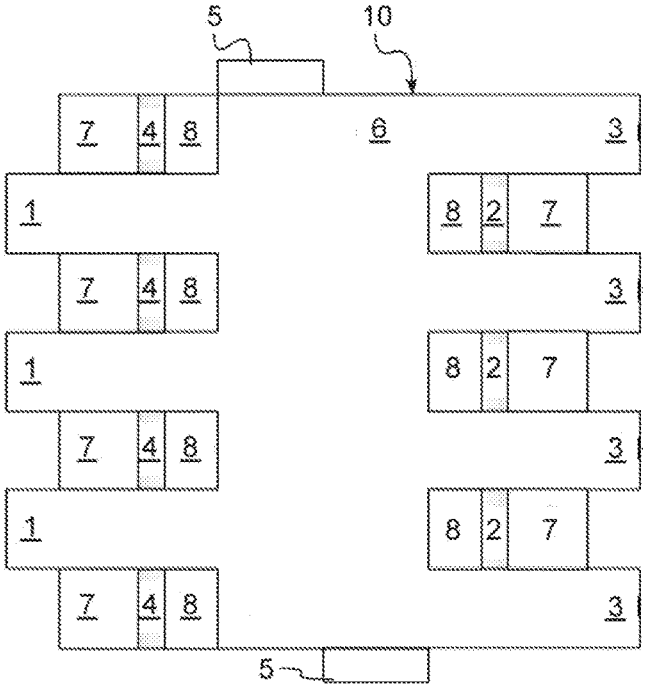
FIG. 3 is a schematic top view of the embodiment shown in FIG. 1 for a formwork plate according to the present invention showing details of the various elements belonging to the formwork plate.
Figure 5:
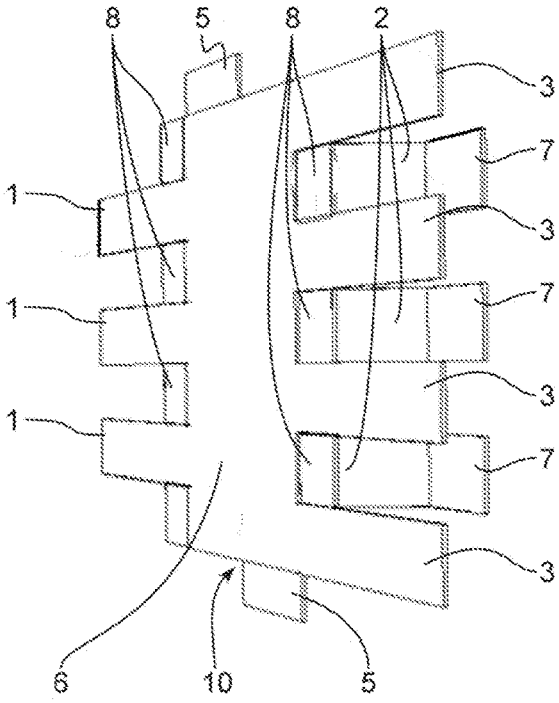
FIG. 5 is a schematic perspective view of the formwork plate shown in FIGS. 3 & 4.
Figure 6:
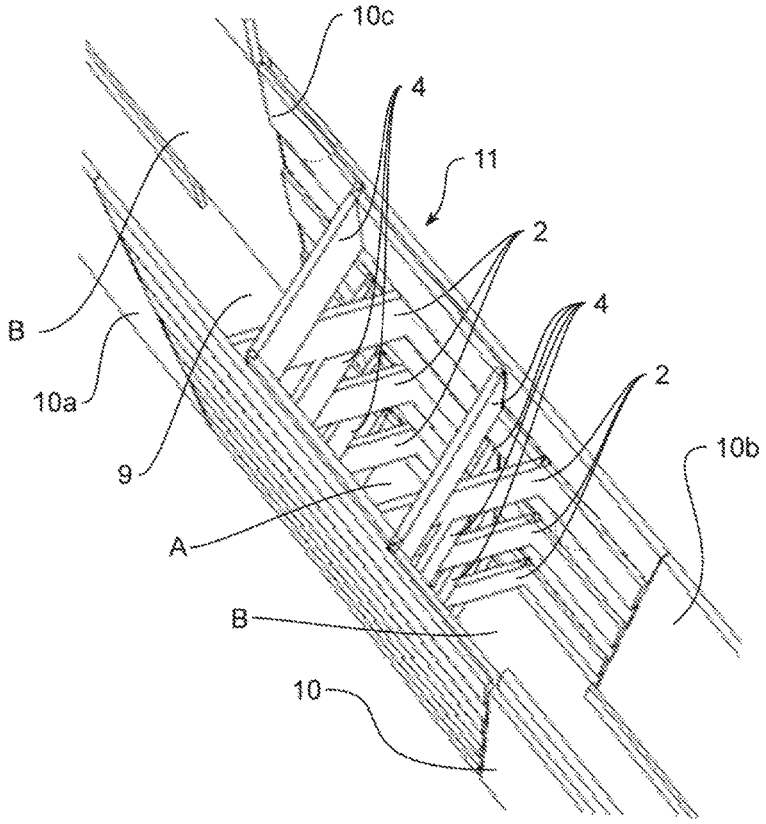
FIG. 6 is a schematic perspective view of one embodiment of a formwork according to the present invention, with such formwork comprising at least four formwork plates.
Figure 7:
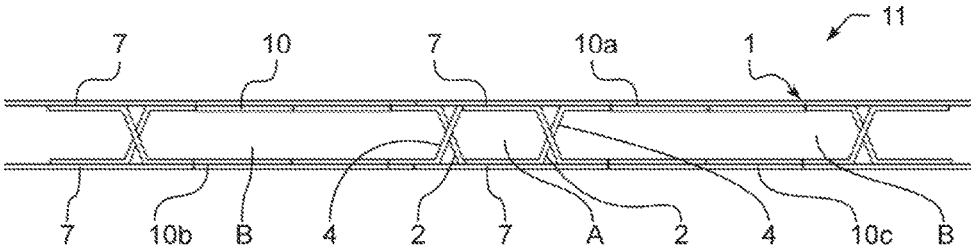
FIG. 7 is a schematic cross-sectional view of one embodiment of a formwork according to the present invention.

The plates are provided with 7 15 cm horizontal parts for horizontally assembling these, as shown in FIGS. 3 and 5.

The plates are provided with two 7 cm pins at the top and at the bottom of the plate, for vertically assembling these. Both pins will be positioned at the back 15 of the zone, as shown in FIG. 3.

The invention is not limited to the embodiments described above and extends to all the embodiments concerned by the claims.

REFERENCES

1. Flat tab
2. Angled portion
3. Flat tab
4. Angled portion
5. Pin
6. Body
7. Distal end portion

8. Connecting portion
9. Volume
10. Formwork plate
10*a*. First plate
10*b*, 10*c*. Second plate
10*d* to 10*g*. Side plate
11. Formwork
12. Construction assembly
13. Wall
14. Floor
15. Arch
16. Ceiling
17. A, B Zones

The invention claimed is:

1. A formwork plate comprising a flat rectangular central body wherein the central body is extended on a first side by a first series of flat tabs, and on a second opposite side by a second series of flat tabs, with the flat tabs extending in the plane of the body while leaving a spacing between the flat tabs of a same series, with the formwork plate further having first and second sets of angled tabs, with at least some angled tabs of the first set extending into the spacing between two flat tabs of the first series, with each angled tab of the second set extending into the spacing between two flat tabs of the second series, with the angled tabs of the first and second sets being angled while extending away from the flat central body each having an angled portion and a flat distal end portion extending parallel to the flat tabs and wherein the angled portion of each angled tab is connected to the flat central body by a flat connecting portion.

2. The formwork plate according to claim 1, wherein each angled portion of the angled tabs forms an angle with the flat distal end portion, with the angle ranging from 100° to 120°.

3. The formwork plate according to claim 2, wherein said angle is equal to 112°.

4. The formwork plate according to claim 1, wherein the sides of the central body carrying no tab each carry a pin.

5. The formwork plate according to claim 1, wherein the first series of flat tabs on the first side is shifted relative to the second series of flat tabs on the second side, with each flat tab of the first series being aligned with a spacing between two flat tabs of the second series and vice versa, one of the two series of flat tabs comprising one tab more than the other series and the set of angled tabs, associated with said series of flat tabs comprising one tab more, comprises one angled tab less.

6. The formwork plate according to claim 5, wherein the number of flat tabs of the first and second series is three and four respectively, whereas the number of angled tabs of the first and second sets is four and three respectively.

7. The formwork plate according to claim 1, wherein the width of the flat tabs of the same series among the first and second series is constant for all the tabs of the series and the width of the spacing between the flat tabs of one series among the first and second series is equal to the width of the flat tabs of the other series.

8. The formwork plate according to claim 1, with the plate being a molded formwork plate, made from molded wood composed of aggregate particles.

9. The formwork plate according to claim 1, with the plate being made of wood or based on aggregate particles.

10. The formwork plate according to claim 9, with the plate being molded.

11. A formwork comprising at least four formwork plates wherein each formwork plate comprising a flat rectangular central body wherein the central body is extended on a first side by a first series of flat tabs, and on a second opposite side by a second series of flat tabs, with the flat tabs extending in the plane of the body while leaving a spacing between the flat tabs of a same series, with the formwork plate further having first and second sets of angled tabs, with at least some angled tabs of the first set extending into the spacing between two flat tabs of the first series, with each angled tab of the second set extending into the spacing between two flat tabs of the second series, with the angled tabs of the first and second sets being angled while extending away from the flat central body each having an angled portion and a flat distal end portion extending parallel to the flat tabs and wherein the formwork comprising:

at least two first formwork plates so joined that the body thereof is positioned in the same first plane;

at least two second formwork plates so joined that the body thereof is positioned in the same second plane different from the first plane and parallel to the first plane;

said at least two first and two second plates being positioned away from each other and back to back with their angled tabs facing one another so as to at least partially define a volume interposed between the first and second plates; and the angled tabs of said at least two first and two second plates being so configured as to cooperate in order to form, in said volume at least three zones, the periphery of which is at least partially defined by the angled tabs.

12. The formwork according to claim 11, wherein the flat distal end portions of the angled tabs of said at least two first plates are supported by at least two second plates and vice versa.

13. The formwork according to claim 11, with the formwork comprising formwork plates positioned side by side with said at least two first and second plates while being adjacent to said at least two first and two second plates on one side having no tab, with each formwork plate having a side pin on each side having no tab, with the side pin of each plate cooperating with the body of one plate positioned laterally and vice versa for holding the two plates together.

14. The formwork according to claim 11, wherein the flat tabs of one of said two first plates are inserted into the spacing between the flat tabs of the other one of said two first plates and the flat tabs of one of said two second plates are inserted into the spacing between the flat tabs of the other one of said two second plates.

15. The formwork according to claim 11, wherein a first zone of said at least three zones is defined, on one side, by the angled tabs of one of said at least two first plates being inserted between the angled tabs of one of said at least two second plates and, on the other side, by the angled tabs of the other one of said at least two first plates being inserted between the angled tabs of the other one of said at least two second plates, with said first zone being at the junction, in the extension of each other, of said at least two first and two second plates respectively.

16. The formwork according to claim 15, wherein the associated angled tabs of the two first and two second plates are in an X shape, by closing each side of the first zone respectively.

17. A construction assembly of a type comprising at least either a wall, or a floor, or an arch, or a ceiling, or at least two of these elements, comprising at least one formwork according to claim 11, with said at least three zones being filled with a selective material, of the concrete, cement, clay, straw, soil, binder or compressed clay soil types.

18. The construction assembly according to claim 17, wherein the selective material is concrete or compressed clay soil, or soil, or straw.

19. The construction assembly according to claim 17, wherein at least one of said at least three zones is filled with a hardenable material.

20. The construction assembly according to claim 17, wherein one or more screws extend through the formwork, with such screws being fixed in the selective material after filling said at least three zones.

21. A method for manufacturing a construction assembly according to claim 17, comprising:

connecting at least two plates positioned in the extension of each other by inserting flat tabs of one into the spacing between the flat tabs of the other one so as to obtain at least two first plates, connecting two plates positioned in the extension of each other by inserting flat tabs of one into the spacing between the flat tabs of the other one so as to obtain at least two second plates, positioning said at least two first and two second plates with the angled tabs thereof facing one another, inserting angled tabs of said at least two first plates between the angled tabs of said at least two second plates, until the flat distal end portions of the angled tabs of said at least two first plates are supported by said at least two second plates and vice versa, the angled tabs of said at least two first and second plates at least partially defining at least three zones in the volume between said at least two first and said at least two second plates, with, for defining one side of a first zone, the angled tabs of one of said at least two first plates being inserted between the angled tabs of one of said at least two second plates and for defining the opposite side of the first zone, the angled tabs of the other one of said at least two first plates being inserted between the angled tabs of the other one of said at least two second plates, positioning and holding side plates on at least one side having no tab of said at least two first and two second plates, if need be, repeating the preceding steps for positioning additional plates in the extension of said at least two first and second plates while forming said at least three zones, among which is the first zone or, for positioning additional side plates in addition to said at least two first and second plates, when a construction of said at least one formwork is complete for manufacturing a construction assembly, introducing a material of the concrete, cement, clay or binder type into the/each first zone, and if need be, introducing a material into the remaining zones among said at least three zones.

22. A formwork plate comprising a flat rectangular central body wherein the central body is extended on a first side by a first series of flat tabs, and on a second opposite side by a second series of flat tabs, with the flat tabs extending in the plane of the body while leaving a spacing between the flat tabs of a same series, with the formwork plate further having first and second sets of angled tabs, with at least some angled tabs of the first set extending into the spacing between two flat tabs of the first series, with each angled tab of the second set extending into the spacing between two flat tabs of the second series, with the angled tabs of the first and second sets being angled while extending away from the flat central body each having an angled portion and a flat distal end portion extending parallel to the flat tabs and wherein the sides of the central body carrying no tab each carry a pin.

* * * * *